United States Patent [19]

Leibfried

[11] 3,947,369

[45] Mar. 30, 1976

[54] LUBRICATING OIL BASE STOCK

[75] Inventor: Raymond Thomas Leibfried, Newark, Del.

[73] Assignee: Hercules Incorporated, Wilmington, Del.

[22] Filed: Feb. 15, 1972

[21] Appl. No.: 226,538

[52] U.S. Cl. ..... 252/57; 252/56 S

[51] Int. Cl.[2] ..... C10M 3/20

[58] Field of Search ..... 252/56 S, 57; 260/475 A, 260/475 R

[56] References Cited

UNITED STATES PATENTS

| | | | |
|---|---|---|---|
| 3,019,188 | 1/1962 | Craven et al. | 252/57 |
| 3,150,092 | 9/1964 | Eickemeyer et al. | 252/56 S X |
| 3,194,764 | 7/1965 | Ovist et al. | 252/56 S |

FOREIGN PATENTS OR APPLICATIONS

| | | | |
|---|---|---|---|
| 847,629 | 9/1960 | United Kingdom | 252/56 S |

OTHER PUBLICATIONS

Barnes et al., "Lubrication Engineering" Aug. 1957, pp. 454–458.

*Primary Examiner*—Delbert E. Gantz
*Assistant Examiner*—Andrew H. Metz
*Attorney, Agent, or Firm*—George H. Hopkins

[57] ABSTRACT

Disclosed is a synthetic oil useful as a base stock for jet engine lubricating oils. The initial viscosity of the synthetic oil at 210°F. is 5.0–5.5 centistokes and at −40°F. is less than 13,000 centistokes. Furthermore, it does not freeze when held at −40°F. for 72 hours. The oil comprises a blend of (1) a pentaerythritol ester product consisting essentially of pentaerythritol material completely esterified by straight chain $C_4$–$C_{10}$ alkanoic acid material, and (2) a trimellitate ester product consisting essentially of trimellitic acid completely esterified by $C_4$–$C_{13}$ alkanol material. The weight ratio of the trimellitate ester product to the pentaerythritol ester product is generally in the range from about 1:10 to about 1:1.

10 Claims, No Drawings

LUBRICATING OIL BASE STOCK

This invention is in the chemical arts. It relates to the lubricant art and particularly to synthetic oil lubricants.

There is a need for a lubricating oil base stock for jet engines and the like, the initial viscosity of which at 210°F. is 5.0–5.5 centistokes, and at −40°F. is less than 13,000 centistokes, and which, when established and maintained for 72 hours at −40°F., will not freeze during that period of time. In this specification initial viscosity at 210°F. is determined according to ASTM Standard D445, while the initial viscosity at −40°F. is determined according to ASTM Standard D2532.

Neopentyl polyol esters have properties which make them useful as synthetic lubricants. However, pentaerythritol esters of straight chain or normal $C_4$–$C_{10}$ alkanoic acids, while useful as lubricants, in general do not meet both viscosity requirements plus the 72 hour nonfreeze requirement. Some of these pentaerythritol esters meet the 210°F. viscosity requirement, but not the −40°F. initial viscosity requirement or the 72 hour nonfreeze requirement. Others meet the −40°F. requirement, but not the 72 hour nonfreeze requirement or the 210°F. requirement. Still others meet none of these requirements.

Hence, a problem to which this invention provides a solution is to provide a synthetic oil that has both the desired initial 210°F. and −40°F. viscosities, and does not freeze at −40°F. when held at that temperature for 72 hours, and which comprises straight chain $C_4$–$C_{10}$ alkanoic acid esters of pentaerythritol.

One approach to a solution of the problem is the addition of branched $C_4$–$C_{10}$ acids to the acid material reacted with pentaerythritol, or to blend branched chain $C_4$–$C_{10}$ alkanoic acid esters of pentaerythritol with the straight chain $C_4$–$C_{10}$ alkanoic acid esters of pentaerythritol. See the U.S. Pat. No. 3,360,465, to Warman. However, currently the cost of branched $C_4$–$C_{10}$ acids is relatively high. Moreover, thermal oxidative stability of the branched acid esters of pentaerythritol is substantially less than what is desired.

This invention provides another solution to the problem, while avoiding the disadvantages of the branched chain acid approach.

In summary, this invention provides a lubricating oil base stock comprising pentaerythritol completely esterified with normal $C_4$–$C_{10}$ alkanoic acid material, which meets both the 210°F. initial viscosity requirement and the −40°F. initial viscosity requirement, and the 72 hour no-freeze requirement. The base stock is composed of a blend of (1) a pentaerythritol ester product consisting essentially of pentaerythritol material completely esterified by straight chain $C_4$–$C_{10}$ alkanoic acid material, and (2) trimellitate ester product consisting essentially of trimellitic acid completely esterified by $C_4$–$C_{13}$ alkanol material. The weight ratio of trimellitate ester product to the pentaerythritol ester product in the blend is generally in the range from about 1:10 to about 1:1.

Pentaerythritol material is material consisting essentially of monopentaerythritol. In some embodiments of this invention it comprises only monopentaerythritol. In other embodiments is comprises monopentaerythritol and one or more polypentaerythritols with the weight ratio of monopentaerythritol to the total polypentaerythritol content being at least about 4:1. Examples of polypentaerythritols include dipentaerythritol, tripentaerythritol, and the like. The technical pentaerythritol product of commerce is an example of pentaerythritol material with a polypentaerythritol content, mostly dipentaerythritol, and having such a weight ratio (88:12).

Straight chain $C_4$–$C_{10}$ alkanoic acid material consists essentially of a normal $C_4$–$C_{10}$ alkanoic acid. In some embodiments of this invention it comprises only one such acid. In other embodiments of this invention it comprises two or more such acids. The normal $C_4$–$C_{10}$ alkanoic acids are:

*n*-butyric acid
*n*-valeric acid
caproic acid
*n*-heptylic acid
caprylic acid
pelargonic acid
capric acid The pentaerythritol ester product in some embodiments of this invention is homogeneous in that it is composed of pentaerythritol material completely esterified by only one straight chain $C_4$–$C_{10}$ alkanoic acid. In other embodiments it is heterogeneous in that it is a mixture comprising pentaerythritol material completely esterified by two or more normal $C_4$–$C_{10}$ alkanoic acids. Such a mixture in some instances is obtained by blending pentaerythritol material completely esterified by one normal $C_4$–$C_{10}$ alkanoic acid with pentaerythritol material completely esterified by a different normal $C_4$–$C_{10}$ alkanoic acid, and, if desired, pentaerythritol material completely esterified by another different normal $C_4$–$C_{10}$ alkanoic acid, etc. In other instances such a mixture is obtained by completely esterifying pentaerythritol material with a mixture of normal $C_4$–$C_{10}$ alkanoic acids.

The pentaerythritol ester product of this invention, the embodiments of which in general are known, is made by wellknown esterification procedures.

The $C_4$–$C_{13}$ alkanol material consists essentially of one $C_4$–$C_{13}$ alkanol. In some embodiments it comprises only one such alkanol. In other embodiments it comprises two or more such alkanols. Examples of $C_4$–$C_{13}$ alkanols include both normal and branched alkanols:

*n*-butyl alcohol
isobutyl alcohol
*t*-butyl alcohol
*n*-amyl alcohol
isoamyl alcohol
*t*-amyl alcohol
*n*-hexyl alcohol
2-ethylbutyl alcohol
4-methyl-2-pentanol
*n*-heptyl alcohol
*n*-octyl alcohol
2-octanol
2-ethylhexyl alcohol
2-ethylisohexyl alcohol
*n*-nonyl alcohol
*n*-decyl alcohol
*n*-undecyl alcohol
*n*-dodecyl alcohol
*n*-tridecyl alcohol and the like. In preferred embodiments only normal alkanols are involved. However, in other embodiments only branched chain alkanols are employed. In still other embodiments both straight and branched alkanols are used.

The trimellitate ester product in some embodiments of this invention is homogeneous in that it is composed of trimellitic acid completely esterified by only one $C_4$–$C_{13}$ alkanol. In other embodiments the product is composed of a mixture of trimellitic acid triesters of $C_4$-$C_{13}$ alkanols. Such a mixture is obtained by mixing the trimellitic acid triester of one $C_4$–$C_{13}$ alkanol with one or more trimellitic acid esters of different $C_4$–$C_{13}$ alkanols, by mixing with a trimellitic acid triester of various $C_4$–$C_{13}$ alkanols with one or more trimellitic acid esters of different $C_4$–$C_{13}$ alkanols, or by completely esterifying trimellitic acid with a mixture of $C_4$–$C_{13}$ alkanols.

The trimellitate esters of this invention, which in general are known, are made, for example, by reacting an excess of the alkanol material with trimellitic anhydride first at a lower temperature to open the anhydride ring and then at higher temperatures to esterify the remaining acid groups. Excess alkanol is separated from the resulting triester product by distillation under reduced pressure, and unreacted acid is removed by treatment with a base.

Although the weight ratio of trimellitate ester product to the pentaerythritol ester product in the oil base stock of this invention is generally in the specified range, the optimum ratio depends on the makeup of the pentaerythritol ester product and the trimellitate ester product. In general, this optimum weight ratio can be approximated according to the equation:

$$\text{Approximate Optimum Weight Ratio} = \frac{V_B - V_{PE}}{V_{TME}}$$

in which $V_B$ is the desired initial 210°F. viscosity in centistokes of the embodiment of the oil base stock to be made, which initial viscosity is selected from the range of viscosities extending from about 5.0 to about 5.5 centistokes, $V_{PE}$ is the initial 210°F. viscosity of the pentaerythritol ester product, and $V_{TME}$ is the initial 210°F. viscosity of the trimellitate ester product. In general the greater the average carbon atom content of the alkanoic acid moieties of the pentaerythritol ester product, the higher is its initial 210°F. viscosity. Consequently, in going from one embodiment of this invention to another embodiment in which the average carbon atom content of the alkanoic acid moieties of the pentaerythritol ester product is higher than in the first embodiment, the average carbon atom content of the alkanol moieties of the trimellitate ester product, the weight ratio of trimellitate ester product to the pentaerythritol ester product or both the average carbon atom content and weight ratio must be reduced to obtain the initial 210°F. viscosity of the first embodiment.

The lubricating oil base stock of this invention is made by blending together at 20°–25°C. the pentaerythritol ester product and the trimellitate ester product.

The best mode now contemplated of carrying out this invention is exemplified by the following working examples of preferred specific embodiments of this invention. This invention is not limited to these specific examples.

EXAMPLE 1

This example illustrates a preferred embodiment of the lubricating oil base stock of this invention in which the pentaerythritol ester product is derived from commercial pentaerythritol.

The formulation of this lubricating oil base stock is:

| Components | Parts By Weight |
|---|---|
| Pentaerythritol Ester Product | 75 |
| Trimellitate Ester Product | 25 |

The pentaerythritol ester product consists essentially of commercial pentaerythritol (99% monopentaerythritol and 1% dipentaerythritol and other polypentaerythritols) completely esterified by a mixture of normal $C_5$–$C_9$ alkanoic acids, the average number of carbon atoms of which is 6.1. (The average carbon atom content is determined as disclosed in the prior art: namely, for each acid moiety in the product multiply the number of carbon atoms in that acid by the mole percent of that acid moiety of the total acid moieties to obtain the carbon atom contribution of that acid moiety and then add the carbon atom contribution of each of the acid moieties to give a sum which is the average carbon atom content in the total acid moieties.)

The trimellitate ester product is composed of trimellitic acid completely esterified with a mixture of normal $C_6$–$C_{10}$ alkanols, the average carbon atom content of which is 8.

The two ester products are made by conventional esterification procedures.

The lubricating oil base stock of this example is made by blending together at 20°–25°C. the pentaerythritol ester product and the trimellitate ester product.

Typical properties of the lubricating oil base stock of this example are as follows:

Initial 210°F. Viscosity = 5.0 centistokes
Initial 100°F. Viscosity = 26 centistokes
Initial −40°F. Viscosity = 9034 centistokes
Extended Viscosity Index (VIE) = 129
Pour Point = −70°F.

| Corrosion and Oxidation Stability (72 hours, 425°F., Test Method of MIL-L-23669B) | |
|---|---|
| Metal | Change In Weight In Milligrams/cm.$^2$ |
| Steel | −0.007 |
| Silver | −0.034 |
| Aluminum | 0.000 |
| Titanium | 0.000 |
| Change in 100°F. Viscosity After 72 Hours At 425°F. | |
| 100°F. Viscosity (ASTM Standard D445) | Centistokes |
| Initial | 26 |
| Final | 36 |

The change in viscosity is +38.5% which is considered acceptable. See MIL-L-23699B.

The corrosion and oxidative stability data, and the 100°F. viscosity change data were obtained on a lubricating oil composed of the base stock of this example and as stabilizers *p,p*-dioctyldiphenylamine and phenyl-β-naphthylamine with the concentration of each amine being 0.75% by weight of the base stock. These stabilizer concentrations are substantially less than those concentrations employed in commercial jet engine lubricants. Hence, the lubricating oil base stock of this invention typically demonstrates superior performance even at low levels of stabilization.

EXAMPLE 2

This example illustrates still another specific embodiment of the lubricating oil base stock of this invention in which the pentaerythritol ester product is derived from commercial pentaerythritol.

The composition of this specific embodiment of the base stock is:

| Components | Parts By Weight |
|---|---|
| Pentaerythritol Ester Product | 65 |
| Trimellitate Ester Product | 35 |

The pentaerythritol ester product in this example consists essentially of commercial pentaerythritol (99% by weight monopentaerythritol and 1% by weight dipentaerythritol and other polypentaerythritols) completely esterified by a mixture of straight chain $C_5$–$C_9$ alkanoic acids, the average carbon atom content of which is 6.1.

The trimellitate ester product consists essentially of trimellitic acid completely esterified by a mixture of $C_7$ alkanols, 90% by weight of which is heptyl alcohol and 10% by weight of which is branched $C_7$ alkanol.

The two ester products are made by conventional procedures, and the base stock is made by blending at 20–25°C. the two ester products.

A typical initial 210°F. viscosity of this base stock is 5.0 centistokes.

The initial −40°F. viscosity of this base stock is less than 13,000 centistokes, and the base stock does not freeze within 72 hours at −40°F. The pour point of the base stock is −55°F.

EXAMPLE 3

This example illustrates a specific embodiment of the lubricating oil base stock of this invention, in which the pentaerythritol ester product is derived from technical pentaerythritol.

The composition of this specific embodiment of the base stock is:

| Components | Parts By Weight |
|---|---|
| Pentaerythritol Ester Product | 82 |
| Trimellitate Ester Product | 18 |

The pentaerythritol ester product in this example consists essentially of technical pentaerythritol (88% by weight monopentaerythritol and 12% by weight dipentaerythritol and other polypentaerythritols) completely esterifed by a mixture of straight chain $C_4$–$C_{11}$ alkanoic acids, the average carbon atom content of which is 6.1.

The trimellitate ester product consists essentially of trimellitic acid completely esterified by a mixture of $C_6$–$C_{10}$ alkanols, the average carbon atom content of which is 8.

The two ester products are made by conventional procedures.

The base stock is made by blending at 20°–25°C. the two ester products.

A typical initial 210°F. viscosity of this base stock is 5.0 centistokes.

A typical initial −40°F. viscosity is 9,248 centistokes.

The base stock of this example does not freeze within 72 hours at −40°F.

EXAMPLE 4

This example illustrates still another specific embodiment of the lubricating oil base stock of this invention, in which the pentaerythritol ester product is derived from technical pentaerythritol.

The composition of this specific embodiment of the base stock is:

| Components | Parts By Weight |
|---|---|
| Pentaerythritol Ester Product | 83 |
| Trimellitate Ester Product | 17 |

The pentaerythritol ester product in this example consists essentially of technical pentaerythritol (88% by weight monopentaerythritol and 12% by weight dipentaerythritol and other polypentaerythritols) completely esterified by a mixture of normal $C_4$ and $C_7$ alkanoic acids (*n*-butyric and *n*-heptylic acids), the average carbon atom content of which is 6.2.

The trimellitate ester product consists essentially of trimellitic acid completely esterified by a mixture of $C_6$–$C_{10}$ alkanols, the average carbon atom content of which is 8.

The two ester products are made by conventional procedures.

The base stock is made by blending at 20°–25°C. the two ester products.

A typical 210°F. viscosity of this base stock is 5.0 centistokes.

A typical −40°F. viscosity of the base stock is 9195 centistokes.

The base stock of this example does not freeze within 72 hours at −40°F.

Consequently, this invention provides a highly desirable lubricating oil base stock especially for use in high temperature applications.

Other features, advantages, and specific embodiments of this invention will become readily apparent to those exercising ordinary skill in the art after reading the foregoing disclosures. In this connection, while specific embodiments of this invention have been described in considerable detail, variations and modifications of these embodiments can be effected without departing from the spirit and scope of the invention as disclosed and claimed.

The expression "consisting essentially of" as used in this specification excludes any unrecited substance at a concentration sufficient to substantially adversely affect the essential properties and characteristics of the composition being defined, while permitting the presence of one or more unrecited substances at concentrations insufficient to substantially adversely affect said essential properties and characteristics.

The definitions of all words and phrases which are detailed in the specification apply to these words and phrases wherever they are used throughout this application, including the claims.

I claim:

1. A composition of matter useful as a base stock for jet engine lubricating oils or the like, which consists essentially of a blend of (1) a pentaerythritol ester product consisting essentially of pentaerythritol material completely esterified by straight chain $C_4$–$C_{10}$ alkanoic acid material, and (2) a trimellitate ester product consisting essentially of trimellitic acid completely esterified by $C_4$–$C_{13}$ alkanol material, the weight ratio of the trimellitate ester product to the pentaerythritol ester product being in the range from about 1:10 to about 1:1.

2. A composition of matter according to claim 1 in which the pentaerythritol material comprises monopentaerythritol at a concentration of at least about 99% by weight of said pentaerythritol material.

3. A composition according to claim 2 in which the alkanoic acid material consists essentially of normal $C_5$–$C_9$ alkanoic acids and the average carbon atom content of said alkanoic acid material is about six.

4. A composition according to claim 3 in which the alkanol material consists essentially of normal $C_6$–$C_{10}$ alkanols and the average carbon atom content of said alkanol material is about eight.

5. A composition according to claim 4 in which said weight ratio is about 1:3.

6. A composition according to claim 3 in which the alkanol material consists essentially of normal and branched chain $C_7$ alkanols.

7. A composition according to claim 6 in which said weight ratio is about 1:1.9.

8. A composition according to claim 1 in which the pentaerythritol material comprises monopentaerythritol at a concentration of about 88% by weight of said pentaerythritol material and has a polypentaerythritol content of about 12% by weight of said pentaerythritol material.

9. A composition according to claim 8 in which the alkanol material consists essentially of normal $C_6$–$C_{10}$ alkanols and the average carbon atom content of said alkanol material is about eight.

10. A lubricating oil consisting essentially of (1) a blend of (A) a pentaerythritol ester product consisting essentially of pentaerythritol material completely esterified by straight chain $C_4$–$C_{10}$ alkanoic acid material, and (B) a trimellitate ester product consisting essentially of trimellitic acid completely esterified by $C_4$–$C_{13}$ alkanol material, the weight ratio of the trimellitate ester product to the pentaerythritol ester product being in the range from about 1:10 to about 1:1, and (2) a stabilizing quantity of stabilizer material.

* * * * *